US008487542B2

(12) United States Patent
Chen

(10) Patent No.: US 8,487,542 B2
(45) Date of Patent: Jul. 16, 2013

(54) LOAD DRIVING APPARATUS AND DRIVING METHOD THEREOF

(75) Inventor: Hsu-Min Chen, Hsinchu (TW)

(73) Assignee: ITE Tech. Inc., Hsinchu (TW)

( * ) Notice: Subject to any disclaimer, the term of this patent is extended or adjusted under 35 U.S.C. 154(b) by 243 days.

(21) Appl. No.: 13/030,129

(22) Filed: Feb. 18, 2011

(65) Prior Publication Data

US 2012/0104949 A1 May 3, 2012

(30) Foreign Application Priority Data

Nov. 3, 2010 (TW) ..... 99137806 A

(51) Int. Cl.
*H05B 39/04* (2006.01)

(52) U.S. Cl.
USPC ..... 315/226; 315/209 R; 315/291; 315/299; 315/307

(58) Field of Classification Search
USPC ..... 315/209 R, 224, 226, 291, 294, 297, 315/299, 307, 362
See application file for complete search history.

(56) References Cited

U.S. PATENT DOCUMENTS

| | | | | |
|---|---|---|---|---|
| 2006/0203922 | A1* | 9/2006 | Rezeq | 375/247 |
| 2006/0208664 | A1* | 9/2006 | Okishima | 315/291 |
| 2011/0280334 | A1* | 11/2011 | Lim et al. | 375/295 |

* cited by examiner

*Primary Examiner* — Douglas W Owens
*Assistant Examiner* — Jianzi Chen
(74) *Attorney, Agent, or Firm* — Jianq Chyun IP Office

(57) ABSTRACT

A load driving apparatus is disclosed. The load driving apparatus includes a driving signal generator and a controller. The driving signal generator is used for providing a driving signal to a load. The controller is used for generating and providing a control signal to the driving signal generator. The driving signal generator generates N integer signals and M fractional signals in a driving period to form the driving signal according to the control signal. N and M are positive integers, and an amplitude of the integer signals is greater than an amplitude of each of the fractional signals.

7 Claims, 6 Drawing Sheets

LOAD DRIVING APPARATUS AND DRIVING METHOD THEREOF

CROSS-REFERENCE TO RELATED APPLICATION

This application claims the priority benefit of Taiwan application serial no. 99137806, filed on Nov. 3, 2010. The entirety of the above-mentioned patent application is hereby incorporated by reference herein and made a part of this specification.

BACKGROUND OF THE INVENTION

1. Field of the Invention

The present invention relates to a load driving apparatus, and more particularly to a load driving apparatus reducing an electromagnetic interference (EMI).

2. Description of Related Art

Referring to FIG. 1A, FIG. 1A is a schematic view of a driving apparatus in a conventional light-emitting diode. In FIG. 1A, the light-emitting diode LD1 is connected in series between a current source I1 and a supply voltage VDD, while the current source I1 receives a control signal CTRL and determines whether to output a current to control the brightness of the light-emitting diode LD1 or not.

Referring to FIGS. 1A and 1B at the same time, FIG. 1B is a waveform graph of the driving apparatus in the light-emitting diode in FIG. 1A. In FIG. 1B, during dimming duration DIT of the driving apparatus, a waveform of a pulse width modulation signal PWM is used as a time for the control signal CTRL to turn on the current source I1, so a current I passes through the light-emitting diode LD1 and enables the light-emitting diode LD1 to emit light. Also, during non-dimming duration NDIT, the current source I1 is turned off through the control signal CTRL to enable the light-emitting diode LD1 not to emit light. The unit duration of the control signal CTRL is labeled by UT, namely, a reciprocal of a frequency of a dimming clock CK. Thus, an average brightness of the light-emitting diode LD1 can be controlled, as long as a duration ratio between the dimming duration DIT and the non-dimming duration NDIT in the dimming period LT is controlled.

It is apparent from the above description that, in order to increase a dimming order of the light-emitting diode LD1, a frequency of a dimming clock CK or duration of a dimming period LT can be increased. However, in addition to increasing current consumption, higher frequency pulse width modulation signals PWM also generate more severe EMI phenomenon, and if the duration of the dimming period LT is increased, a dimming frequency is reduced; as the dimming frequency is the reciprocal of the dimming period, if the dimming frequency is below 20 kHz, an audible sound is generated. Therefore, both the modes above affect the overall performance of the system.

SUMMARY OF THE INVENTION

The present invention provides a load driving apparatus. The load driving apparatus includes a driving signal generator and a controller. The driving signal generator is coupled to a load and used for providing a driving signal to the load. The controller is coupled to the driving signal generator and used for generating and providing a control signal to the driving signal generator. According to the control signal, the driving signal generator generates N integer signals and M fractional signals in a driving period to form the driving signal. The N and M are positive integers, and amplitude of the integer signals is greater than amplitude of each fractional signal.

In an embodiment of the present invention, a load driving apparatus is used for driving a light-emitting diode. Additionally, the present invention provides a load driving method suitable for controlling a switch coupled to a load. When the switch is on, a fractional current passes through the load. The method includes: receiving a pulse width modulation signal; generating a pulse width modulation output signal, and synchronizing the pulse width modulation output signal with a dimming clock signal, in which the pulse width modulation output signal has dimming duration and non-dimming duration; and during the dimming duration and/or the non-dimming duration, controlling switch-on duration of the switch.

Based on the above, in the present invention, a load is driven by generating a complete driving signal through combination of generated one or more integer signals and one or more fractional signals. Therefore, when the complete driving signal is turned on or off, the driving signal can be turned on through increment of the fractional signals or turned off through decrement of the fractional signals. In addition, in the present invention, the resolution of driving signal adjustment can also be increased by utilizing fractional signals without increasing the frequency of the system. Therefore, the EMI phenomenon that might occur when the driving signal is turned on or off can be effectively reduced, so the overall performance is enhanced.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
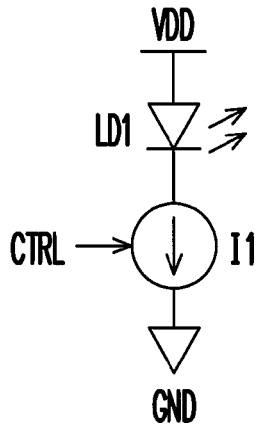
FIG. 1A (RELATED ART)
FIG. 1A is a schematic view of a driving apparatus in a conventional light-emitting diode.
Figure 1B:
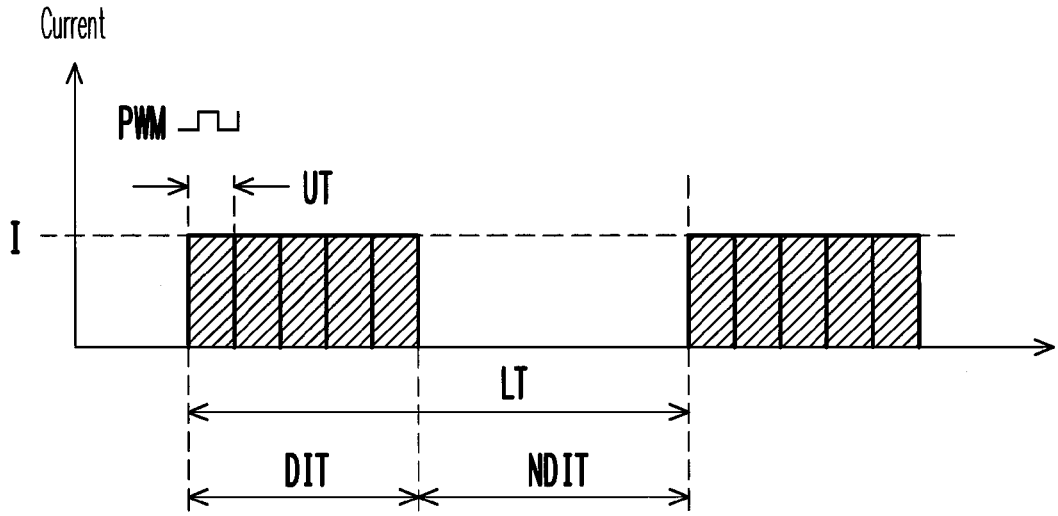
FIG. 1B (RELATED ART)
FIG. 1B is a waveform graph of the driving apparatus in the light-emitting diode in FIG. 1A.

Reference will now be made in detail to the present embodiments of the invention, examples of which are illustrated in the accompanying drawings. Wherever possible, the same reference numbers are used in the drawings and the description to refer to the same or like parts.

Figure 2A:
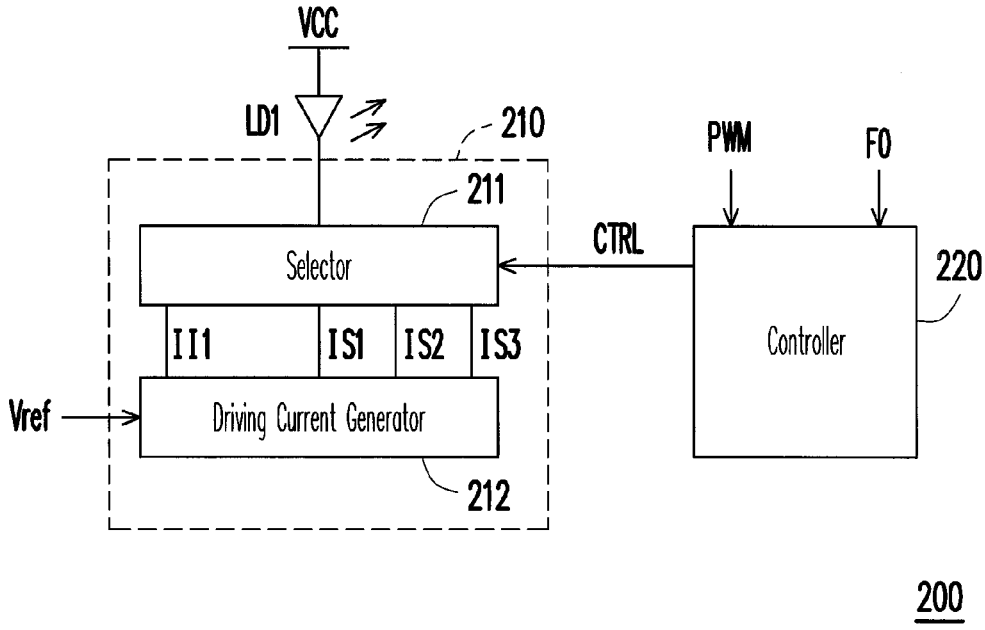
FIG. 2A is a schematic view of a load driving apparatus 200 according to an embodiment of the present invention.

Referring to FIG. 2A, FIG. 2A is a schematic view of a load driving apparatus 200 according to an embodiment of the present invention. In this embodiment, the load driving apparatus 200 is used for driving a light-emitting diode LD1 coupled to a supply voltage VCC. The load driving apparatus 200 includes a driving signal generator 210 and a controller 220. The driving signal generator 210 is coupled to the light-emitting diode LD1 as a load, and the driving signal generator 210 is used for providing a driving signal to the light-emitting diode LD1. The above driving signal can be a driving current or a driving voltage. The controller 220 is coupled to the driving signal generator 210 and used for generating and providing a control signal CTRL to the driving signal generator 210.

It is noted that the driving signal generator 210 generates N integer signals and M fractional signals in a driving period to form the driving signal according to the control signal CTRL, in which N and M are positive integers. Also, amplitude of the integer signals is greater than amplitude of each of the fractional signals.

Figure 2B:
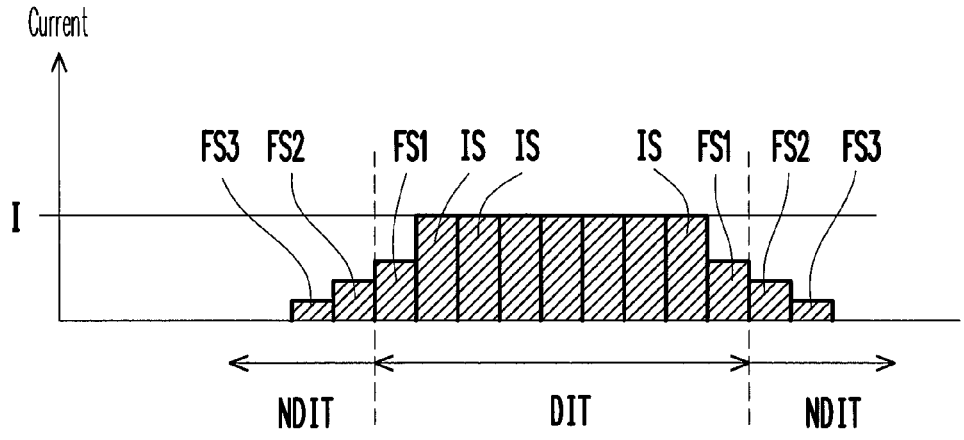
FIG. 2B is a waveform graph of a driving signal according to the embodiment in FIG. 2A.

Now referring to FIG. 2B, FIG. 2B is a waveform of a driving signal according to the embodiment in FIG. 2A. A dimming period is divided into dimming duration DIT and non-dimming duration NDIT. The controller 220 transports the control signal CTRL and enables the driving signal generator 210 to generate an integer signal IS or a fractional signal FS. In this embodiment, the controller 220 controls the driving signal generator 210 by using the control signal CTRL to generate the integer signals IS and the fractional signals FS1 during the driving duration DIT, and generates fractional signals FS2 and FS3 during the non-dimming duration NDIT. The amplitude of the fractional signals FS1, FS2, and FS3 is smaller than the amplitude of the integer signal IS.

It is noted that the amplitude of the fractional signals FS1, FS2, FS3, . . . FSn, and FSn+1 generated by the driving signal generator 210 is gradually decreased for the distance between each of the fractional signals FS1-FSn and the integer signals IS is getting farther. That is, the amplitude of the FSn+1 is smaller than or equal to the amplitude of the FSn. Briefly, taking FIG. 2B an example, the amplitude of the fractional signal FS3 can be half of the amplitude of the fractional signal FS2, the amplitude of the fractional signal FS2 is half of the amplitude of the fractional signal FS1, and the amplitude of the FS1 is half of the amplitude of the IS.

Of course, the relationship between the amplitudes of the fractional signals FS1 to FS3 can have another proportion, the above proportion of the amplitudes of the fractional signals FS1 to FS3 is only an example, and the present invention is not limited thereto.

It is apparent from FIGS. 2A and 2B, the load driving apparatus 200 according to the embodiment of the present invention can adjust the brightness of the light-emitting diode LD1 by adjusting the number of the fractional signals FS1 to FS3 and the integer signals IS without increasing the frequency of the dimming clock or the duration of the dimming period. Also, the occurrence of the EMI phenomenon can further be effectively reduced with the fractional signals FS1 to FS3 having decremented amplitude.

Referring to FIG. 2A again, the driving signal generator 210 includes a selector 211 and a driving current generator 212. The driving current generator 212 receives a reference voltage Vref and generates a main current II1 and a plurality of fractional currents IS1 to IS3 according to the reference voltage Vref. Each of the fractional currents IS1, IS2, and IS3 have different current values from each other, and the current value of the main current II1 is greater than the current values of the fractional currents IS1, IS2 and IS3.

The selector 211 is coupled to the driving current generator 212. The selector 211 selects to output the main current II1 and/or selects to output the fractional currents IS1, IS2, and IS3 according to the control signal CTRL.

Referring to FIGS. 2A and 2B, when the driving signal generator 210 needs to generate the integer signals IS, the selector 211 selects the main current II1 to output to the light-emitting diode LD1 according to the control signal CTRL. When the driving signal generator 210 needs to generate the fractional signal FS1, the selector 211 selects the fractional current FS1 to output to the light-emitting diode LD1 according to the control signal CTRL. On the contrary, when the driving signal generator 210 needs to generate the fractional signal FS2 or FS3, the selector 211 respectively selects the fractional current FS2 or FS3 to output to the light-emitting diode LD1 according to the control signal CTRL.

Figure 3:
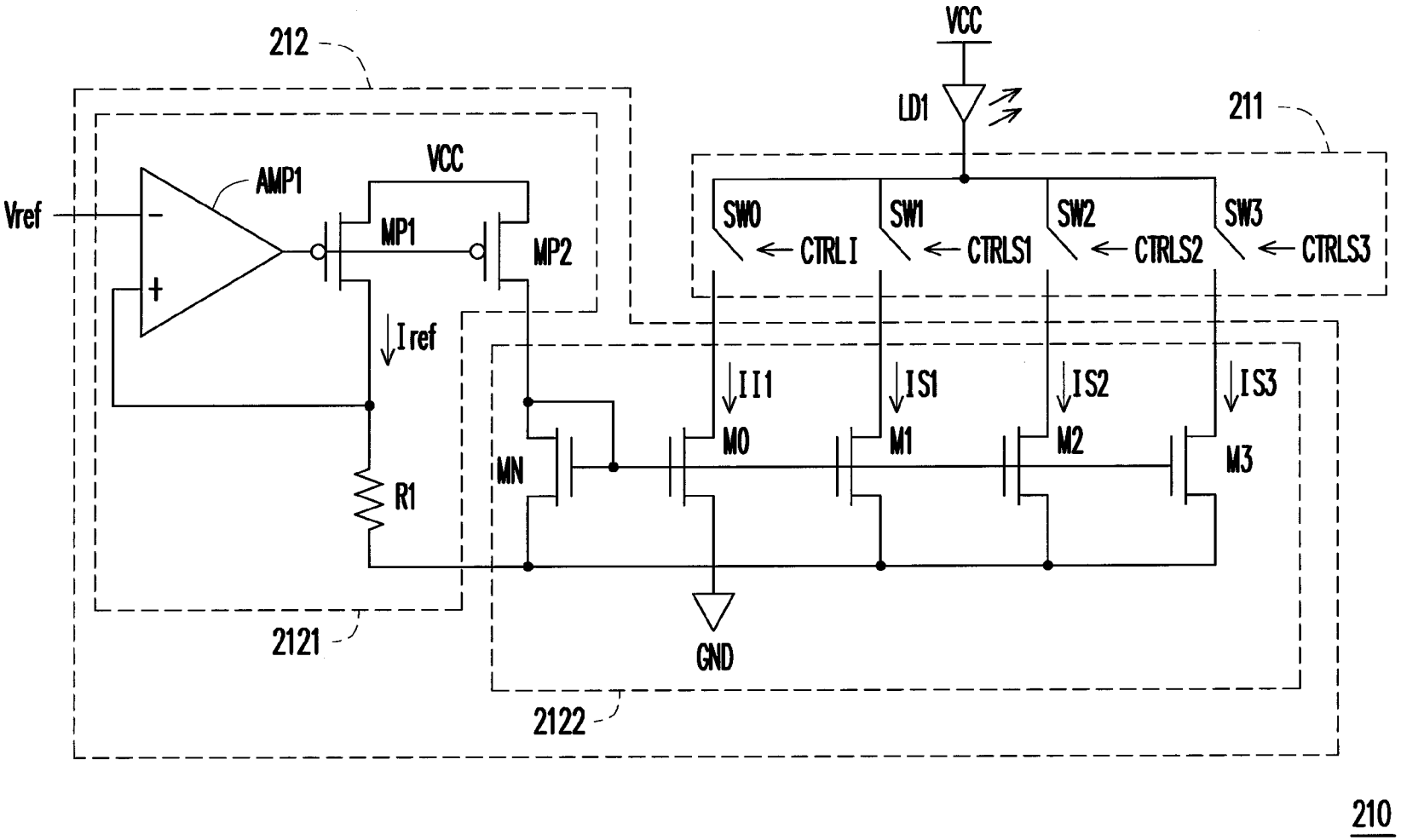
FIG. 3 shows an implementation of a driving signal generator 210 according to the present invention.

Now referring to FIG. 3, FIG. 3 is an implementation of the driving signal generator 210 according to the embodiment of the present invention. A driving current generator 212 of the driving signal generator 210 includes a reference current generator 2121 and a current mirror 2122. The reference current generator 2121 receives the reference voltage Vref and generates a reference current Tref according to the reference voltage Vref. The current mirror 2122 is coupled to the reference current generator 2121. The current mirror 2122 mirrors the reference current Iref to generate the main current I11 and the fractional currents IS1 to IS3.

The reference current generator 2121 includes an operational amplifier AMP1, transistors MP1 and MP2, and a resistor R1. An input end of the operational amplifier AMP 1 receives the reference voltage Vref. The transistor MP1 has a first source/drain, a second source/drain, and a gate. The first source/drain receives the supply voltage VCC, the gate is coupled to an output end of the operational amplifier AMP1, and the second source/drain is coupled to another input end of the operational amplifier AMP1. Similarly, the transistor MP2 has a first source/drain, a second source/drain, and a gate. The first source/drain receives the supply voltage VCC, the gate is coupled to the gate of the transistor MP1, and the second source/drain generates the reference current Iref. The resistor R1 is connected in series between the second source/drain of the transistor MP1 and a ground voltage GND.

The current mirror 2122 includes transistors MN and M0 to M3. A first source/drain of the transistor MN receives the reference current Iref, a second source/drain thereof is coupled to the ground voltage GND, and a gate thereof is coupled to the first source/drain. The second sources/drains of the transistors M0 to M3 are commonly coupled to the ground voltage GND, and gates of the transistors M0 to M3 are commonly coupled to the gate of the transistor MN, and first sources/drains of the transistors M0 to M3 respectively generate the integer current II1 and the fractional currents IS1 to IS3.

The selector 211 is constructed of a plurality of switches SW0 to SW3. The switches SW0 to SW3 are respectively connected in series between the first sources/drains of the transistors M0 to M3 and the light-emitting diode LD1. The switch SW0 is controlled by an integer control portion CTRL1 of the control signal CTRL, and the switches SW1 to SW3 are respectively controlled by the fractional control portions CTRLS1 to CTRLS3 of the control signal CTRL. Specifically, when the switch SW0 is turned on according to the integer control portion CTRL1 of the control signal CTRL, and the main current II1 flows through the light-emitting diode LD1. On the contrary, if at least one of the switches SW1 to SW3 is turned on according to the fractional control portions CTRLS1 to CTRLS3 of the control signal CTRL, at least one of the fractional currents IS1 to IS3 flows through the light-emitting diode LD1.

Figure 4A:
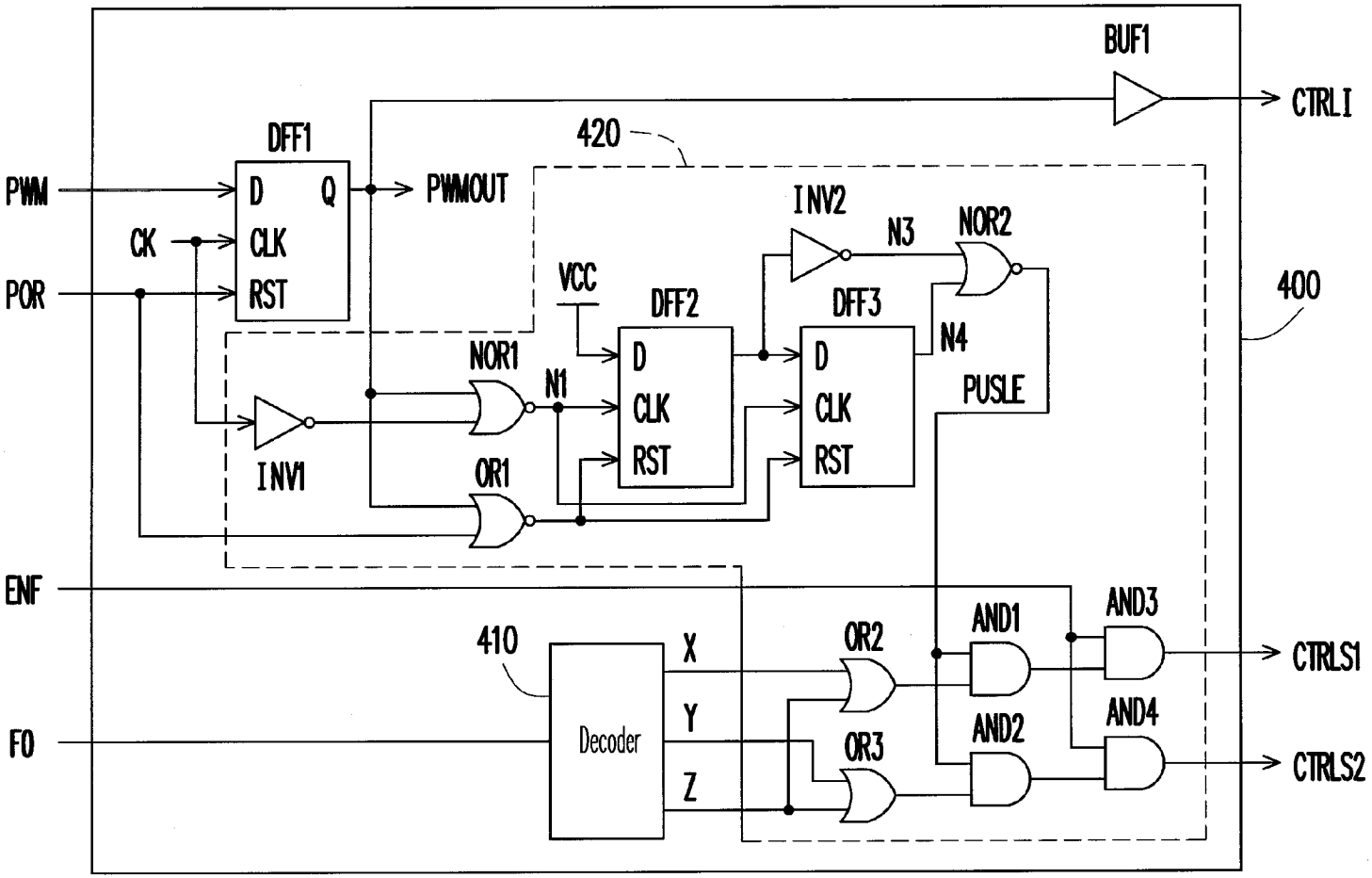
FIG. 4A shows an implementation of a controller of a load driving apparatus according to the present invention.

Now referring to FIG. 4A in conjunction with FIG. 2A, FIG. 4A is an implementation of the controller of the load driving apparatus according to the present invention. A controller 400 includes an integer control signal generator consisting of a flip-flop DFF1 and a buffer BUF1 and a fractional control signal generator including a decoder 410 and a logic operation unit 420.

In the integer control signal generator, a data end D of the flip-flop DFF1 receives a pulse width modulation signal PWM, a clock end CLK thereof receives a dimming clock signal CK with a frequency higher than that of the pulse width modulation signal PWM, and a reset end RST thereof receives a reset signal POR. The buffer BUF1 is coupled to the output end Q of the flip-flop DFF1, and the buffer BUF1 is used for generating the integer control portion CTRL1 of the control signal CTRL. In the fractional control signal generator, the decoder 410 receives the input signal F0 and decodes the input signal F0. The logic operation unit 420 is coupled to the decoder 410 and receives a decoding result generated by the decoder 410 according to the input signal F0. The logic operation unit 420 generates the fractional control portions CTRLS1 and CTRLS2 according to the above decoding result and the integer control portion CTRLI. In addition, in the implementation, the logic operation unit 420 additionally receives a signal ENF as the reference for whether to generate the fractional control portions CTRLS1 and CTRLS2 or not.

Figure 4B:
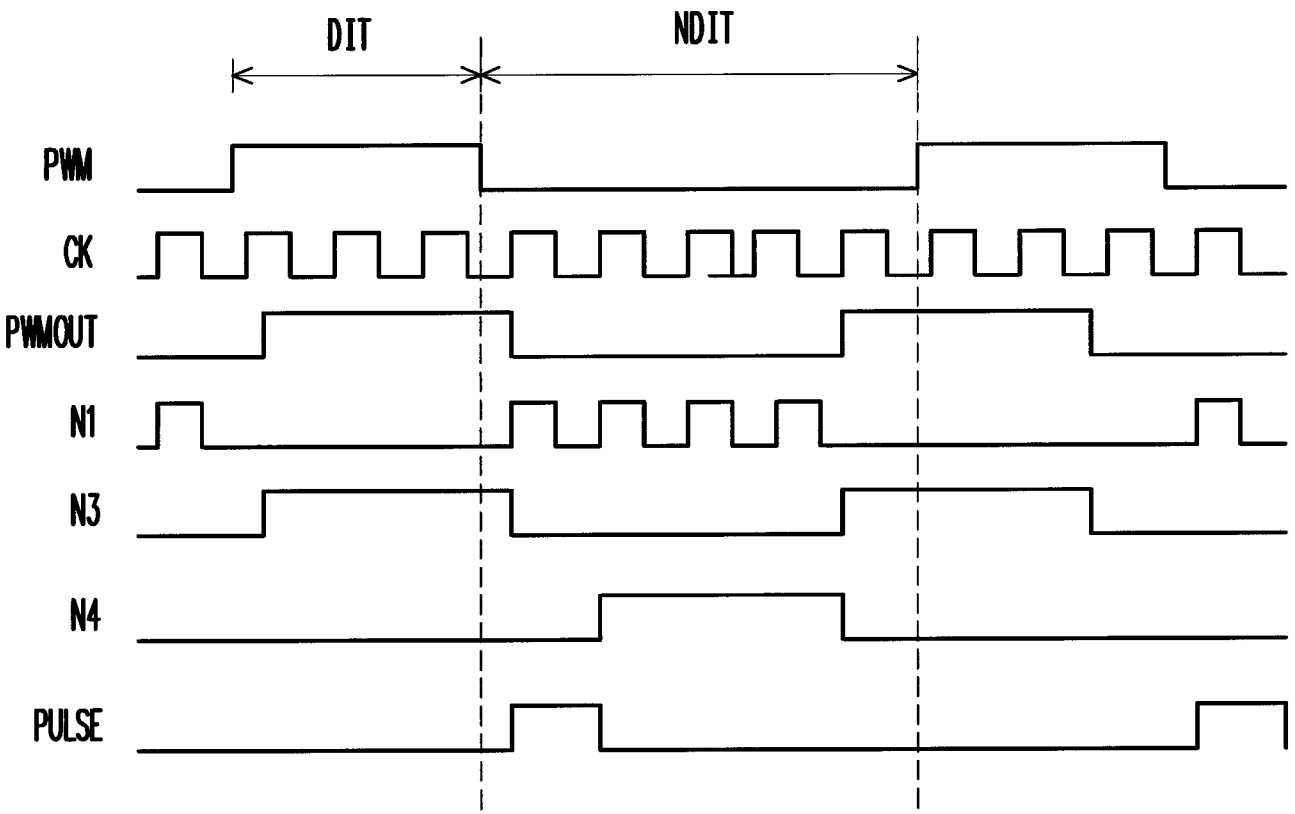
FIG. 4B is a waveform graph of the controller 400.

For action details of the controller 400, referring to FIGS. 4A and 4B, FIG. 4B is a waveform graph of the controller 400. The flip-flop DFF1 synchronizes the pulse width modulation signal PWM with the dimming clock signal CK, so as to generate a pulse width modulation output signal PWMOUT. When the pulse width modulation output signal PWMOUT is at a high level, the load driving apparatus to which the controller 400 belongs is in the dimming duration DIT. On the contrary, when the pulse width modulation output signal PWMOUT is at a low level, the load driving apparatus to which the controller 400 belongs is in the non-dimming duration NDIT. As the pulse width modulation output signal PWMOUT is synchronized with the dimming clock signal CK, it can be known how many clocks the dimming duration DIT lasts, and how many clocks the non-dimming duration NDIT lasts, so that the controller 400 can control the fractional control signals are output at which clock of the dimming duration DIT and the non-dimming duration.

Flip-flops DFF2 and DFF3, NOT gates INV1 and INV2, an OR gate OR1, and NOR gates NOR1 and NOR2 are configured to generate a pulse signal PULSE according to the falling edge of the pulse width modulation output signal PWMOUT. The signal PULSE generates a pulse after one delay of the falling edge of the pulse width modulation output signal PWMOUT. And nodes N1, N3, and N4 are outputs of the NOR gate NOR1, the NOT gate INV2, and the flip-flop DFF3, respectively.

The signal PULSE is used for indicating a time point to generate the fractional control portions CTRLS1 and CTRLS2, and when the signal PULSE is a positive pulse, the controller 400 generates the fractional control portions CTRLS1 and CTRLS2 according to the input signal F0 and the signal ENF. For further explanation, in this embodiment, the decoder 410 decodes the input signal F0 and generates the decoding results X, Y, and Z. The relationship between the input signal F0 and the decoding results is as follows:

| F0 | X | Y | Z |
|---|---|---|---|
| Floating | High Level | Low Level | Low Level |
| Low Level | Low Level | High Level | Low Level |
| High Level | Low Level | Low Level | High Level |

The decoding results X, Y, and Z are further transmitted to the logic circuit consisting of the OR gates OR2 and OR3 and AND gates AND1 to AND4, so as to achieve functions as follows. When the signal ENF is at a high level and when the input signal F0 is floating, the fractional control portion CTRLS1 generates the positive pulse signal, and the fractional control portion CTRLS2 doesn't transit (staying at the low level). When the input signal F0 is at the low level, the fractional control portion CTRLS2 generates the positive pulse signal, and the fractional control portion CTRLS1 doesn't transit (staying at the low level). Alternatively, when the input signal F0 is at the high level, the fractional control portions CTRL1 and CTRLS2 generate the positive pulse signals. If the fractional control portions CTRLS1 and CTRL2 respectively control generation of the fractional currents IS1 and IS2, when the signal ENF is at the high level and the input signal F0 is floating, the reference current generator generates the fractional current IS1. When the input signal F0 is at the low level, the reference current generator generates the fractional current IS2; and when the input signal F0 is at the high level, the reference current generator generates the fractional currents IS1+IS2.

The controller in the load driving apparatus shown in FIG. 4A is an embodiment that is used for generating an integer control signal CTRLI and two fractional control signals CTRLS1 and CTRLS2. However, embodiments in which more fractional control signals are generated can be readily derived by those skilled in the art.

Figure 5:
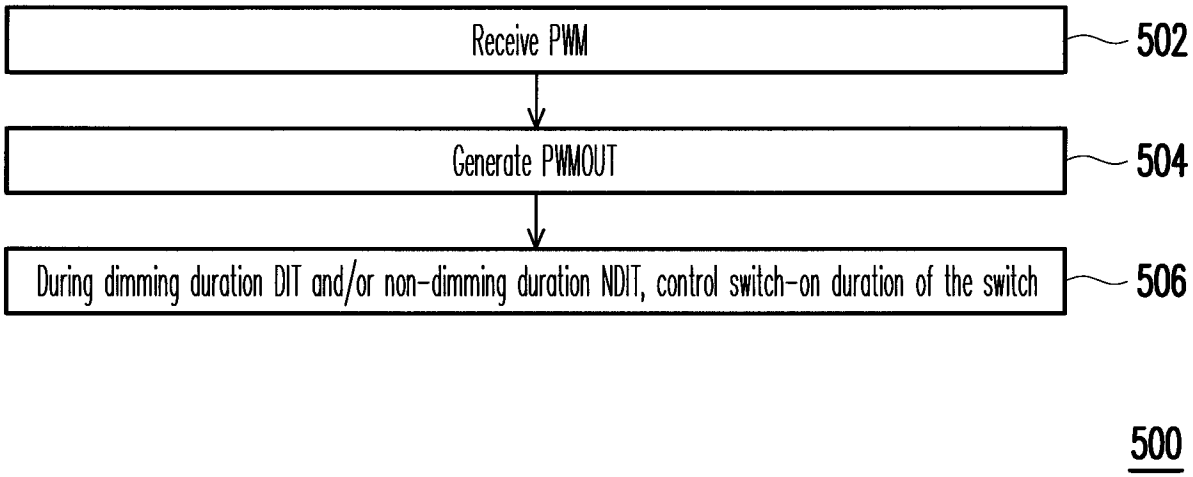
FIG. 5 is a flowchart of a load driving method 500.

FIG. 5 is a flowchart of a load driving method 500 according to another embodiment of the present invention. A controller is used for controlling one or more switches coupled to a load. When the switch is turned on, a fractional current passes through the load. As shown in FIG. 5, the load driving method includes: in Step 502, receiving a pulse width modulation signal PWM; in Step 504, synchronizing the pulse width modulation signal PWM with a dimming clock signal CK, so as to generate a pulse width modulation output signal PWMOUT, in which the pulse width modulation output signal PWMOUT has dimming duration DIT and non-dimming duration NDIT; in Step 506, controlling switch-on duration of the switch during the dimming duration DIT and/or the non-dimming duration NDIT. For example, as shown in FIG. 2B, during the dimming duration DIT, when the time of controlling the one or more switches to be turned on is the first and ninth dimming clock signals CK, the intensity of the fractional current flowing through the load is half of the integer current; during the non-dimming duration NDIT as shown on the right side of FIG. 2B, when the time of controlling the switches to be turned on is the first and second dimming clock signals CK, during the first dimming clock signal CK, the amplitude of the fractional current flowing through the load is quarter of the integer current, and during the second dimming clock signal CK, the amplitude of the fractional current flowing through the load is ⅛ of the integer current.

It will be apparent to those skilled in the art that various modifications and variations can be made to the structure of the present invention without departing from the spirit and scope of the invention. In view of the foregoing, it is intended that the present invention covers modifications and variations of this invention provided they fall within the scope of the following claims and their equivalents.

What is claimed is:

1. A load driving apparatus, comprising:

a driving signal generator, coupled to a load, and used for providing a driving signal to the load; and a controller, coupled to the driving signal generator, and used for generating and providing a control signal to the driving signal generator, wherein, the driving signal generator generates N integer signals and M fractional signals in a driving period to form the driving signal according to the control signal, N and M are positive integers, and amplitude of the integer signals is greater than an amplitude of each of the fractional signals.

2. The load driving apparatus according to claim 1, wherein the driving signal generator comprises:

a driving current generator, used for receiving a reference voltage and generating a main current and one or more fractional currents according to the reference voltage; and a selector, coupled to the driving current generator, and used for selecting to output the main current or selecting to output the fractional currents according to the control signal.

3. The load driving apparatus according to claim 2, wherein the selector comprises:

a plurality of switches, connected to the load in serial, wherein the switches are turned on or off according to the control signal, respectively.

4. A light-emitting diode driving apparatus, comprising:

a driving signal generator, coupled to a light-emitting diode, and used for providing a driving signal to the light-emitting diode; and a controller, coupled to the driving signal generator, and used for receiving a pulse width modulation signal and generating a control signal to the driving signal generator;

wherein, the driving signal generator generates N integer signals and M fractional signals in a dimming period to form the driving signal according to the control signal, N and M are positive integers, and an amplitude of the integer signals is greater than an amplitude of each of the fractional signals.

5. The light-emitting diode driving apparatus according to claim 4, wherein the driving signal generator comprises:

a driving current generator, used for receiving a reference voltage and generating a main current and one or more fractional currents according to the reference voltage; and a selector, coupled to the driving current generator, and used for selecting to output the main current or selecting to output the fractional currents according to the control signal.

6. The light-emitting diode driving apparatus according to claim 5, wherein the selector comprises:

a plurality of switches, connected to the load in serial, wherein the switches are turned on or off according to the control signal, respectively.

7. The light-emitting diode driving apparatus according to claim 4, wherein the controller comprises:

a flip-flop, used for synchronizing the pulse width modulation signal with a dimming clock signal.

* * * * *